US009746163B1

(12) United States Patent
Acosta, Sr. et al.

(10) Patent No.: US 9,746,163 B1
(45) Date of Patent: Aug. 29, 2017

(54) EASY USE HOOK SYSTEM FOR SUSPENDING LIGHT STRANDS

(71) Applicants: Gilbert Acosta, Sr., La Puente, CA (US); Gilbert Acosta, Jr., La Puente, CA (US)

(72) Inventors: Gilbert Acosta, Sr., La Puente, CA (US); Gilbert Acosta, Jr., La Puente, CA (US)

( * ) Notice: Subject to any disclaimer, the term of this patent is extended or adjusted under 35 U.S.C. 154(b) by 0 days.

(21) Appl. No.: 14/588,930

(22) Filed: Jan. 3, 2015

Related U.S. Application Data

(60) Provisional application No. 61/923,594, filed on Jan. 3, 2014.

(51) Int. Cl.

| | |
|---|---|
| ***F21V 21/02*** | (2006.01) |
| ***F21V 21/08*** | (2006.01) |
| ***F21S 4/00*** | (2016.01) |
| *F21W 121/00* | (2006.01) |

(52) U.S. Cl.
CPC ..... *F21V 21/0832* (2013.01); *F21S 4/001* (2013.01); *F21W 2121/004* (2013.01)

(58) Field of Classification Search
CPC ..... F21S 4/10; F21V 21/08; F21V 21/088; F21V 21/0832; F21V 19/0025; F21V 19/001; F21V 19/06; A47G 33/10; A47G 33/105; A47G 33/04
USPC ..... 362/396
See application file for complete search history.

(56) References Cited

U.S. PATENT DOCUMENTS

| | | | | |
|---|---|---|---|---|
| 860,543 | A * | 7/1907 | Howard | F21V 19/06 431/111 |
| 1,801,077 | A * | 4/1931 | Gentry | E04D 3/3606 411/377 |
| 2,553,012 | A * | 5/1951 | Schwaibold | G04B 37/085 368/291 |
| 2,936,989 | A * | 5/1960 | Clarence Siek | E06C 7/16 182/117 |
| 4,431,701 | A * | 2/1984 | Hamada | C08K 3/36 174/110 S |
| 5,388,802 | A | 2/1995 | Dougan et al. | |
| 5,542,636 | A * | 8/1996 | Mann | A47G 33/105 248/229.15 |
| 6,644,836 | B1 | 11/2003 | Adams | |
| 2006/0017407 | A1 * | 1/2006 | Wang | F21S 4/20 315/312 |
| 2012/0198680 | A1 * | 8/2012 | Durben | A47G 25/08 29/428 |

OTHER PUBLICATIONS

Copper.ORG, Bigger Really Is Better, Feb. 26, 2009, https://web.archive.org/web/20090226060821/http://copper.org/applications/electrical/building/a6119.html.*

* cited by examiner

*Primary Examiner* — Andrew Coughlin
*Assistant Examiner* — Keith Delahoussaye
(74) *Attorney, Agent, or Firm* — RG Patent Consulting, LLC; Rachel Gilboy

(57) ABSTRACT

An apparatus for an easy and safe method for installing a hook system for suspending outdoor holiday light strands on the roof lines of homes and businesses having one-piece-mountable-hooks able to be placed on a roof line of a building. Various embodiments of the one-piece-mountable-hooks are described to fit different types of roof lines and a roof line having a rain gutter.

8 Claims, 6 Drawing Sheets

EASY USE HOOK SYSTEM FOR SUSPENDING LIGHT STRANDS

CROSS-REFERENCE TO RELATED APPLICATION

The present application is related to and claims priority from prior provisional application Ser. No. 61/923,594, filed Jan. 3, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of light display and securing means for light strands and more specifically relates to an easy use hook system for suspending light strands.

2. Description of the Related Art

The winter holiday season is a magical time of year. Celebrating Christmas, Hanukkah, or Kwanza, can renew one's faith and revive the spirit of giving that is often lacking throughout the year. In particular, Christians celebrate Christmas in the United States and across the globe. Spending time with friends and family, shopping for gifts and sending colorful greeting cards, are wonderful activities that most who celebrate Christmas enjoy. One of the many prevalent ways people share their enthusiasm with others is by decorating their homes for the holiday season. A wonderful way to decorate for the holidays is by hanging strands of brilliantly lit lights outside of the home. Providing a sense of warmth and comfort, strung lights welcome guests and holiday revelers in a friendly and joyous fashion. Although typically associated with Christmas, string lights are increasingly being embraced by consumers as an affordable and attractive means of decorating throughout the year. Manufactured in a multitude of colored sets, many enjoy hanging colored, themed lights from season to season. Shimmery and beautiful, a strand of lights can add the perfect finishing touch to virtually any decor.

Although striking to look at, string lights are not without their drawbacks. Specifically, hanging strands of outdoor holiday lights can be a difficult task. Standing atop a tall ladder and attempting to secure the lights to the trim of one's roof can be both awkward and exhausting. Trying to wrap the light strands around a home's rain spouts or trim, only to have the lights slip and hang unattractively can take the fun out of decorating. Because getting the lights to stay in place can be so difficult, this part of decorating can take a great amount of time. To facilitate this process, many consumers attempt to secure their lights via wire or sharp nails. Unfortunately, repeatedly twisting and bending the strands of lights in order to hang them properly, or securing the lights with nails and wire, can cause punctures, tears or shorts in the light strand, often leading to painful and dangerous electric shocks. Additionally, considering that most holiday lights are utilized during inclement winter months when frequent snow, rain, sleet and ice storms are commonplace, hanging damaged, torn or frayed lights with exposed electrical wires can present a serious fire hazard. A safe and efficient means for hanging light strands is desirable.

Various attempts have been made to solve the above-mentioned problems such as those found in U.S. Pat. No. 5,388,802 to William B. Dougan, et al, U.S. Pat. No. 6,644,836 to William E. Adams, and U.S. Pat. No. 5,542,636 to John P. Mann, et al. This art is representative of light display and securing means for light strands. None of the above inventions and patents, taken either singly or in combination, is seen to describe the invention as claimed.

Ideally, an easy use hook display system for light strands should provide an easy and safe method for installing a hook system for suspending outdoor holiday light strands on the roof lines of homes and, yet would operate reliably and be manufactured at a modest expense. Thus, a need exists for a reliable easy use hook system for suspending light strands to avoid the above-mentioned problems.

BRIEF SUMMARY OF THE INVENTION

In view of the foregoing disadvantages inherent in the known light display and securing means for light strands art, the present invention provides a novel easy use hook system for suspending light strands. The general purpose of the present invention, which will be described subsequently in greater detail, is to provide an easy and safe method for installing a hook system for suspending outdoor holiday light strands on the roof lines of homes.

An easy use hook system for suspending light strands is disclosed herein, in a preferred embodiment, comprising a plurality of one-piece-mountable-hooks, each of the one-piece-mountable hooks structured and arranged comprise a left-mounting-hook-portion, a right-mounting-hook-portion, a left-length-portion having a left-length-first-end and a left-length-second-end, a right-length-portion having a right-length-first-end and a right-length-second-end, and a light-string-holder-portion having a light-string-holder-length and a light-string-holder-curved-hook.

As a one piece unit, each of the one-piece-mountable-hooks is manufactured with the left-mounting-hook-portion interfused to a left-length-first-end of the left-length-portion, the right-mounting-hook-portion interfused to a right-length-first-end of the right-length-portion, the left-length-second-end of the left-length-portion interfused to the first-end of the light-string-holder-length, and the right-length-second-end of the right-length-portion interfused to the first-end of the light-string-holder-length.

Each of the one-piece-mountable-hooks structurally arranged comprises a birdy-clip for use on buildings having raised tiles and a metal-bird-stop, designed to repel birds. The birdy-clip comprises heavy duty stainless steel material for suitable corrosion resistance against ambient weather. Each of the birdy-clips is mountable on the metal-bird-stop on a facial-board by placing the left-mounting-hook-portion and the right-mounting-hook-portion through a weep-hole on the metal-bird-stop. The birdy-clip is held in place via pressure as the left-mounting-hook-portion and the right-mounting-hook-portion are tensed against the edge of the weep-hole. The birdy-clip comprises a tapered V-shape from a top of the birdy-clip to the first-end of the light-string-holder-length.

The birdy-clip, in those particular embodiments, further comprises a birdy-clip-length of about one and one/fourth inch between a top of the birdy-clip to a bottom of the birdy-clip. To form the V-shape, the birdy-clip comprises a width of about three/fourths inch across a top-side of the birdy-clip as the second-end of the left-length-portion and the second-end of the right-length-portion are joined together at the first-end of the light-string-holder-length. The light-string-holder-portion comprises a light-string-holder-portion-length of about seven/eights inch and is dipped in a rubber-composition to provide a cushion for the string of decorative lights when in use. Other sizes may be available.

The light-string-holder-portion is able to hold a section of a string of decorative lights comprising holiday lights without the need to wrap, bend or twist the light string, thereby, reducing punctures and damage to the string of decorative lights. Since the string of decorative lights lays on the light-string-holder-curved-hook, the user is further protected from electric shocks and burns during installation. The string of decorative lights extends the length of the outside wall of the building using an appropriate number of birdy-clips.

When in use, a user is able to place as many of the plurality of one-piece-mountable-hooks as desired in series to suspend a string of decorative lights on an outside wall of a building by attaching each of the one-piece-mountable-hooks on the outside wall of the building via the left-mounting-hook-portion and the right-mounting-hook-portion inserted into a weep-hole on the metal-bird-stop and then suspend a string of decorative lights using each of the light-string-holder-curved-hooks of the light-string-holder-portion along the length of the outside wall of a building.

The present invention holds significant improvements and serves as an easy use hook system for suspending light strands. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, easy use hook system for suspending light strands, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a light display and securing means for light strands and more particularly to an easy and safe method for installing a hook system for suspending outdoor holiday light strands on the roof lines of homes and businesses. The light display and securing means for light strands offers a variety of one-piece-mountable-hooks designed to accommodate different styles of roofing found on homes. The hook system for suspending outdoor holiday light strands may also be used on business buildings as desired.

Figure 1:
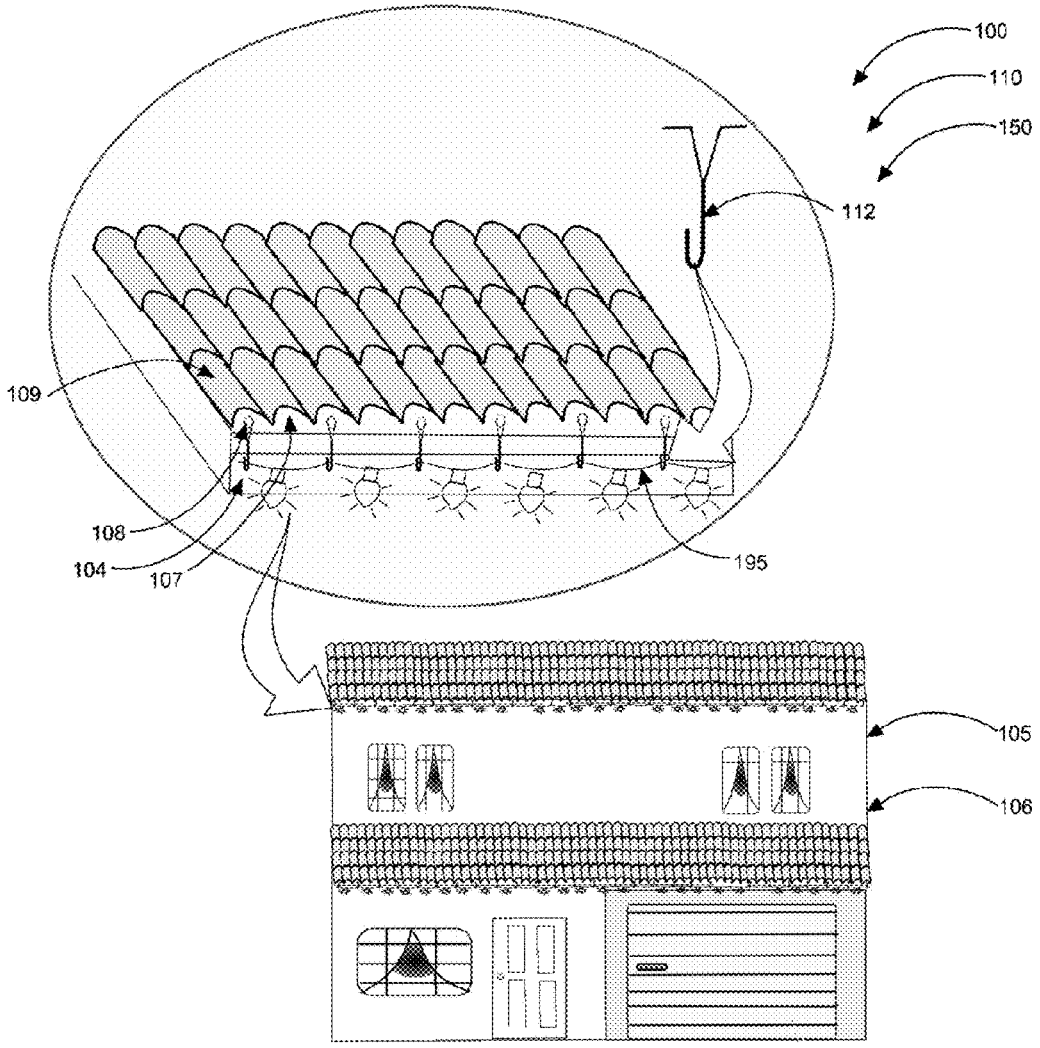
FIG. 1 shows a perspective view an easy use hook system for suspending light strands one-piece-mountable-hook birdy-clips in an in use condition according to an embodiment of the present invention.

Referring to the drawings by numerals of reference there is shown in FIG. 1, a perspective view illustrating easy use hook system for suspending light strands 100 one-piece-mountable-hook 110 birdy-clips 112 in an in use condition 150 according to an embodiment of the present invention.

Easy use hook system for suspending light strands 100 comprises a plurality of one-piece-mountable-hooks 110, each of one-piece-mountable hooks 110 comprising birdy-clip 112. Each birdy-clip 112 structured and arranged comprises left-mounting-hook-portion 120, right-mounting-hook-portion 126, left-length-portion 121 having left-length-first-end 122 and left-length-second-end 123, right-length-portion 125 having right-length-first-end 127 and right-length-second-end 128, and light-string-holder-portion 130 having light-string-holder-length 131 and light-string-holder-curved-hook 132.

When in use, a user is able to place as many of plurality of one-piece-mountable-hook 110 birdy-clips 112 as desired in a series to suspend string of decorative lights 195 comprising holiday lights on outside wall 106 of building 105 via left-mounting-hook-portion 120 and right-mounting-hook-portion 126 inserted into weep-hole 108 on metal-bird-stop 107 and then suspend string of decorative lights 195 using each of light-string-holder-curved-hooks 132 of light-string-holder-portion 130 along the length of the outside wall 106 of building 105. The holiday lights may comprise lights celebrating Christmas, Hanukkah, Kwanza and lights celebrating any other holiday or purpose as desired by the user.

Figure 2:
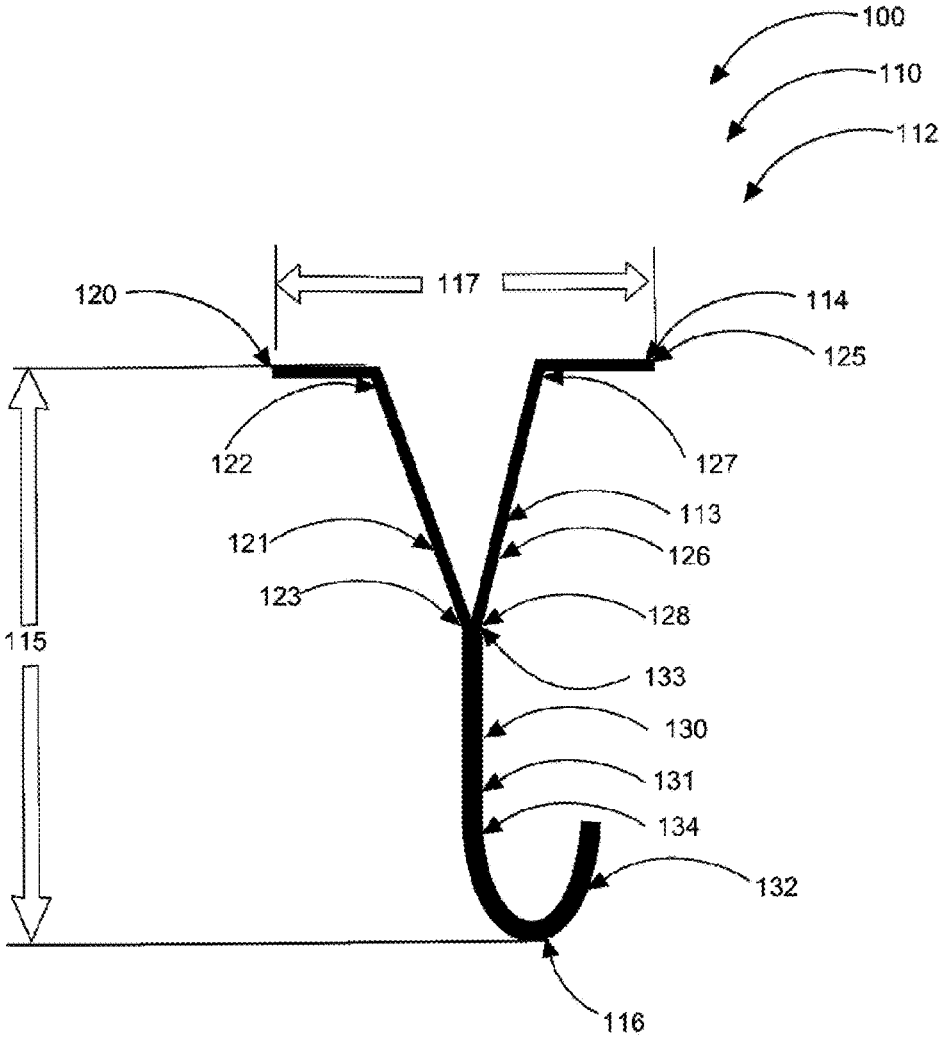
FIG. 2 is a perspective view illustrating an easy use hook system for suspending light strands one-piece-mountable-hook birdy-clips according to an embodiment of the present invention of FIG. 1.

Referring now to FIG. 2 a perspective view illustrating easy use hook system for suspending light strands 100 one-piece-mountable-hook 110 birdy-clips 112 according to an embodiment of the present invention of FIG. 1.

As a one piece unit, each of one-piece-mountable-hook 110 birdy-clips 112 is manufactured with left-mounting-hook-portion 120 interfused to left-length-first-end 122 of left-length-portion 121, right-mounting-hook-portion 126 interfused to right-length-first-end 127 of right-length-portion 125, left-length-second-end 123 of left-length-portion 121 interfused to first-end 133 of light-string-holder-length 131, and right-length-second-end 128 of right-length-portion 126 interfused to first-end 133 of light-string-holder-length 131.

Each of structurally arranged birdy-clips 112, for use on buildings 105 having raised tiles 109 and metal-bird-stops 107 designed to repel birds, comprises heavy duty stainless steel material for suitable corrosion resistance against ambient weather. Each of birdy-clips 112 is mountable on metal-bird-stop 107 on facial-board 104 by placing left-mounting-hook-portion 120 and right-mounting-hook-portion 126 through weep-hole 108 on metal-bird-stop 107. Each of birdy-clips 112 is held in place via pressure as left-mounting-hook-portion 120 and right-mounting-hook-portion 126 are tensed against the edge of weep-hole 108. Birdy-clip 112 comprises tapered V-shape 113 from top 114 of birdy-clip 112 to first-end 133 of light-string-holder-length 130.

Birdy-clip 112 further comprises birdy-clip-length 115 of about one and one/fourth inch between top 114 of birdy-clip 112 and bottom 116 of birdy-clip 112. To form the V-shape, birdy-clip 112 comprises birdy-clip-width 117 of about three/fourths inch across a top-side of birdy-clip 112 as left-length-second-end 123 of left-length-portion 121 and right-length-second-end 128 of right-length-portion 126 are joined together at first-end 133 of light-string-holder-length 131. Light-string-holder-portion 130 comprises light-string-holder-portion-length 131 of about seven/eights inch and is dipped in rubber-composition 134 to provide a cushion for string of decorative lights 195 when in use. Other sizes may be available.

Light-string-holder-portion 130 is able to hold a section of a string of decorative lights 195 comprising holiday lights without the need to wrap, bend or twist the light string, thereby, reducing punctures and damage to string of decorative lights 195. Since string of decorative lights 195 lays on light-string-holder-curved-hook 132 having rubber-composition 134 coating, the user is further protected from electric shocks and burns during installation. String of decorative lights 195 extends the length of outside wall 106 of building 105 using an appropriate number of birdy-clips 112.

Figure 3:
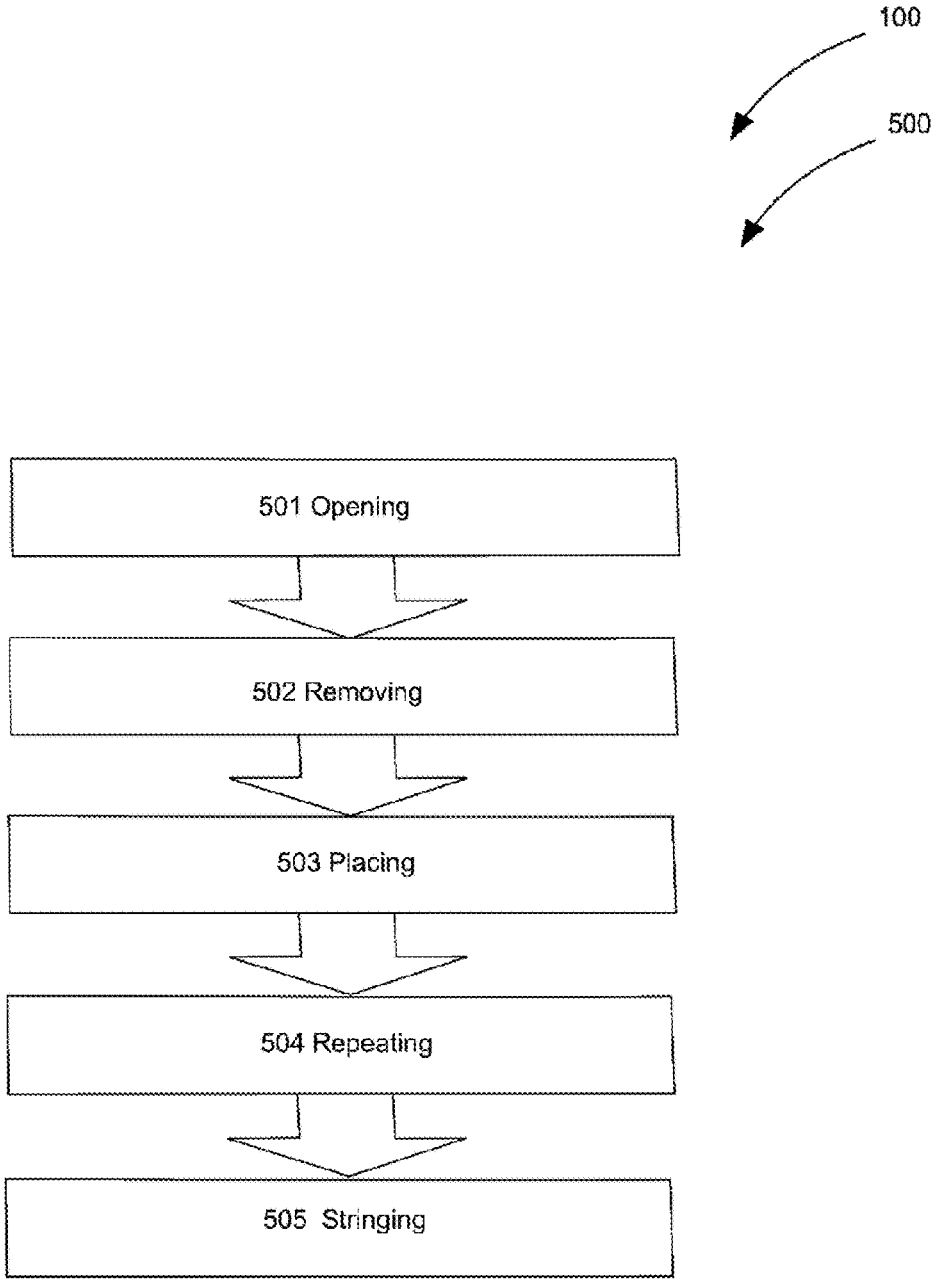
FIG. 3 is a perspective view illustrating a method of use for an easy use hook system for suspending light strands for light strand one-piece-mountable-hook birdy-clips according to an embodiment of the present invention of FIGS. 1-2.

Referring now to FIG. 3 is a flowchart illustrating method of use 500 for easy use hook system for suspending light strands 100 one-piece-mountable-hook 110 birdy-clips 112 according to an embodiment of the present invention of FIGS. 1-2.

Method of use 500 for easy use hook system for suspending light strands 100 one-piece-mountable-hook 110 birdy-clips 112 comprises the steps of: step one 501 opening a package containing plurality of one-piece-mountable-hook 110 birdy-clips 112; step two 502 removing birdy-clip 112 from the package; step three 503 placing birdy-clip 112 on metal-bird-stop 107 via inserting left-mounting-hook-portion 120 and right-mounting-hook-portion 126 into weep-hole 108 of metal-bird-stop 107; step four 504 repeating step 502 and step 503 as often as needed to decorate a length of outside-wall 106 of building 105; and step five 505 stringing decorative light string 195 using each of birdy-clips 112.

It should be noted that the steps described in the method of use can be carried out in many different orders according to user preference. The use of "step of" should not be interpreted as "step for", in the claims herein and is not intended to invoke the provisions of 35 U.S.C. §112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

Figure 4:
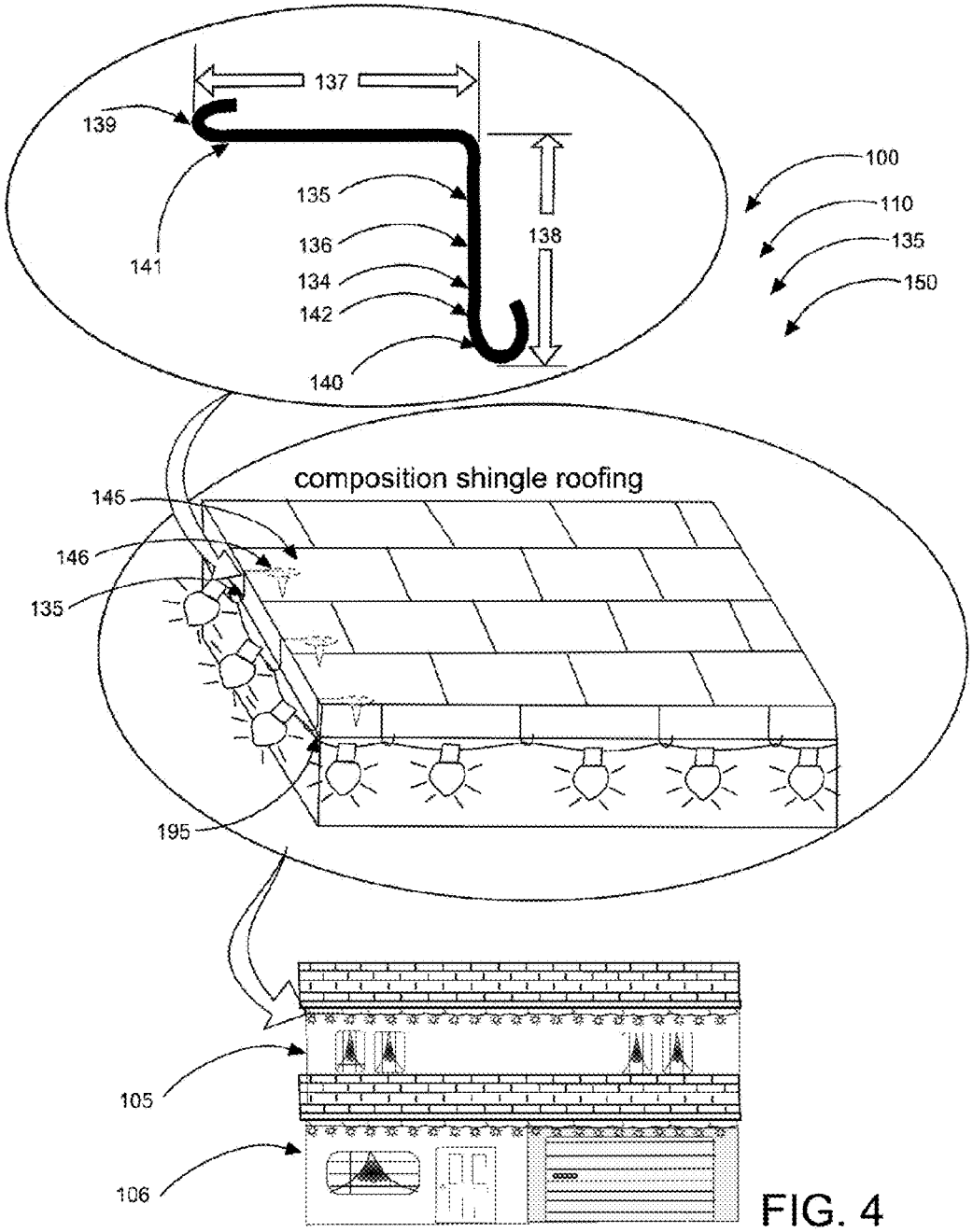
FIG. 4 is a perspective view illustrating an easy use hook system for suspending light strands plurality of one-piece-mountable-hook nellie-clips in an in use condition according to an embodiment of the present invention.

Referring now to FIG. 4 a perspective view illustrating easy use hook system for suspending light strands 100 plurality of one-piece-mountable-hook 110 nellie-clips 135 in an in use condition 150 according to an embodiment of the present invention.

In an alternate embodiment easy use hook system for suspending light strands 100 comprises plurality of one-piece-mountable-hook 110 nellie-clips 135. Each of one-piece-mountable hook 110 nellie-clips 135 structurally arranged comprises L-shaped-hook 136 comprising nail-hook-length 137 and light-wire-hook-length 138, nail-hook 139 and light-wire-hook 140.

As a one piece unit, each of one-piece-mountable-hook 110 nellie-clips 135 is manufactured with nail-hook 139 interfused to first-end 141 of L-shaped-hook 136, and light-wire-hook 139 is interfused to second-end 142 of L-shaped-hook 136. Nail-hook-length 137 of L-shaped-hook 136 comprises a length of about two inches and light-wire-hook-length 138 comprises a length of about one and one/quarter inch. Other sizes may be available.

Nellie-clip 135 comprises 12 gauge wire to prevent damage from ambient environmental moisture. Other non-corrosive material may also be used for nellie-clip 135. Approximately seven/eights inch of light-wire-hook-length 138 of L-shaped-hook 136 and light-wire-hook 140 are dipped into rubber composition 134 to provide a cushion for string of decorative lights 195 when in use. Each of light-wire-hooks 140 is able to hold a section of string of decorative lights 195.

Nellie-clip 135 is structured and arranged for use on building 105 having composition roofing shingles. Each of nellie-clips 135 is attached to a roof board under composition shingle tab 145 via composition roofing nail 146 by inserting composition roofing nail 146 through nail-hook 139 and driving composition roofing nail 146 into the roof board.

When in use, a user is able to place as many of plurality of one-piece-mountable-hook 110 nellie-clips 135 as desired to suspend string of decorative lights 195 on outside wall 106 of building 105 by securing L-shaped-hook 136 to a roof board under composition shingle tab 145 by inserting composition roofing nail 146 through nail-hook 139 and driving composition roofing nail 146 into the roof board and then suspend string of decorative lights 195 using each of L-shaped-hooks 136 of one-piece-mountable-hook 110 nellie-clips 135 for a length of outside-wall 106 of building 105.

Figure 5:
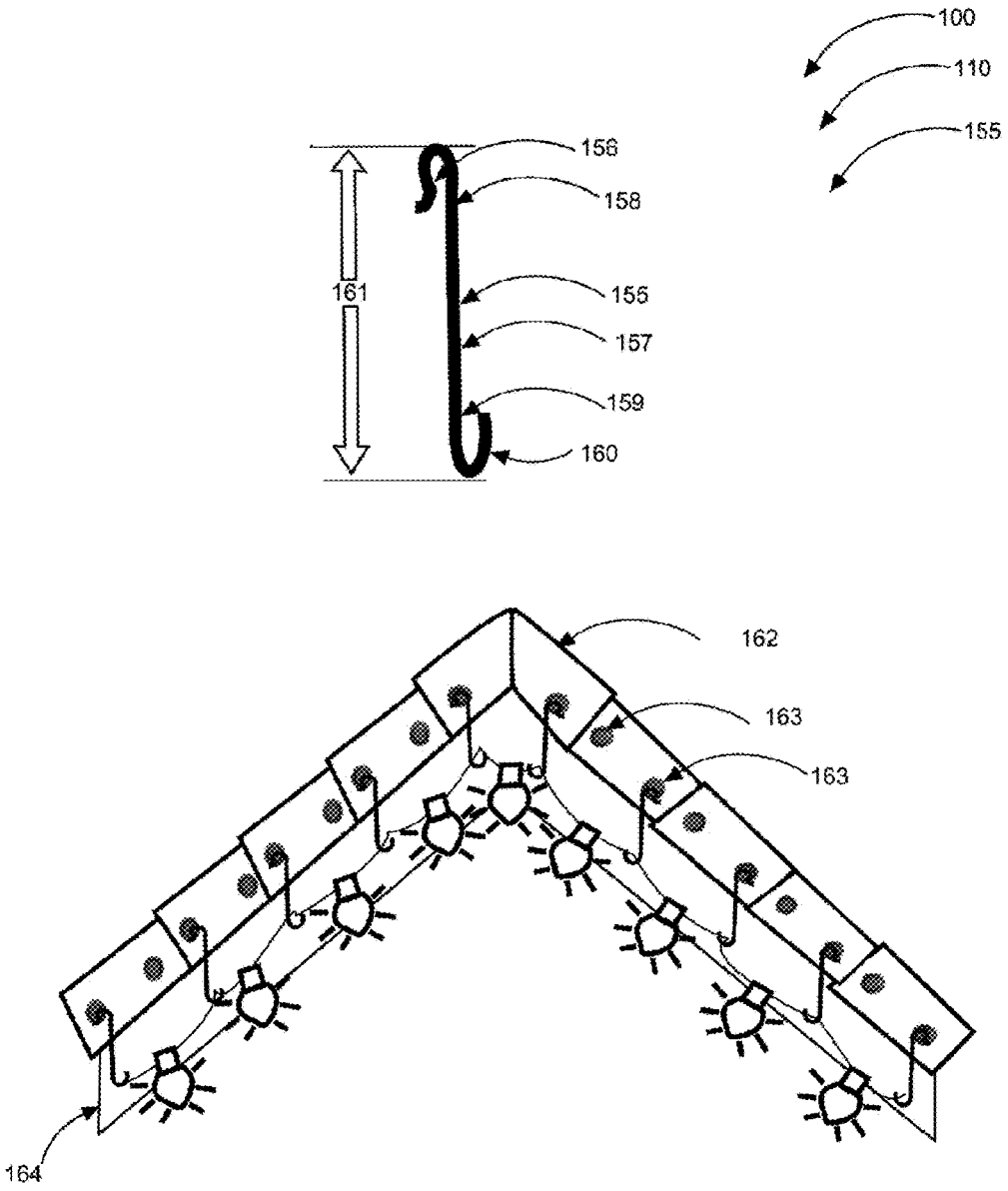
FIG. 5 is a flowchart illustrating a method of use for an easy use hook system for suspending light strands one-piece-mountable-hook nellie-clip according to an embodiment of the present invention of FIG. 4.

Referring now to FIG. 5 a perspective view illustrating easy use hook system for suspending light strands 100 one-piece-mountable-hook 110 rakie-clip 155 according to an embodiment of the present invention.

In a second alternate embodiment easy use hook system for suspending light strands 100 comprises plurality of one-piece-mountable-hook 110 rakie-clips 155. Each of one-piece-mountable hooks 110 rakie-clips 155 comprises nail-hook 156 elongated-shaft 157 having elongated-shaft-first-end 158, elongated-shaft-second-end 159 and light-wire-hook 160. Rakie-clip 155 comprises shaft-length 161 of about three inches. Other sizes may be available.

As a one piece unit, each of one-piece-mountable-hook 110 rakie-clips 155 is manufactured of 12 gauge wire for suitable corrosion resistance against ambient weather, with nail-hook 156 interfused to elongated-shaft-first-end 158 of elongated-shaft 157 and light-wire-hook 160 interfused to elongated-shaft-second-end 159 of elongated-shaft 157. Approximately seven-eighths inch of elongated-shaft 157 and light-wire-hook 160 are dipped into a rubber composition to provide a cushion for string of decorative lights 195 when in use. Each of light-wire-hooks 160 is able to hold a section of string of decorative lights 195. Other non-corrosive materials may also be used for the construction of rakie-clips 155.

Rakie-clip 155 is structured and arranged for use on building 105 having rake-edges on tile roofing. Each of one-piece-mountable-hook 110 rakie-clips 155 is attached to building 105 under rake 162 of the tile roof via attaching nail-hook 156 to rake nail 163 used to secure rake 162 to facial board 164.

When in use, a user is able to place as many of plurality of one-piece-mountable-hook 110 rakie-clips 157 as desired to suspend string of decorative lights 195 on outside wall 106 of building 105.

Figure 6:
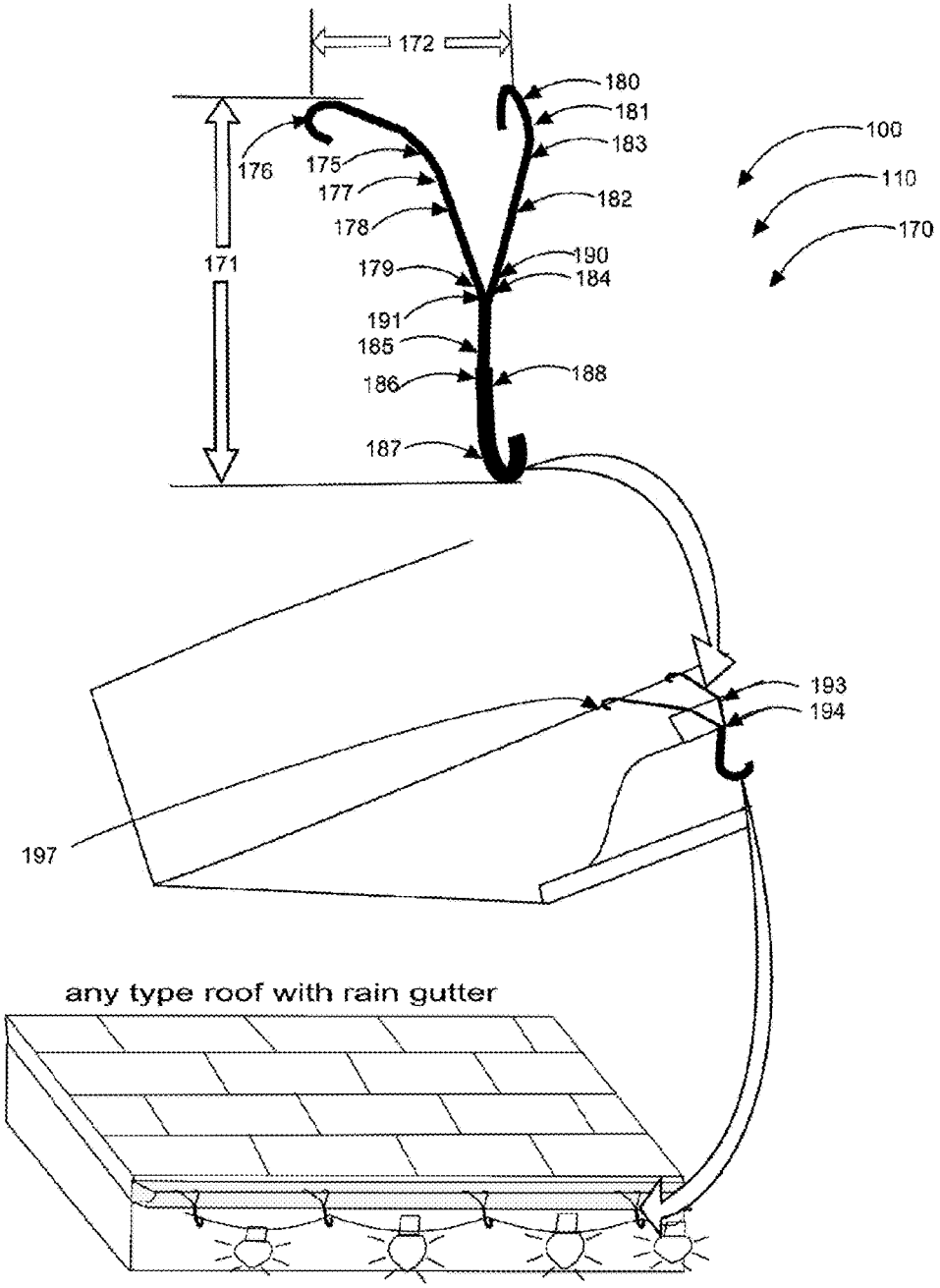
FIG. 6 is a perspective view illustrating an easy use hook system for suspending light strands one-piece-mountable-hook rainie-clip according to an embodiment of the present invention.

Referring now to FIG. 6 a perspective view illustrating easy use hook system for suspending light strands 100 one-piece-mountable-hook 110 rainie-clip 170 according to an embodiment of the present invention.

In a third alternate embodiment easy use hook system for suspending light strands 100 comprises plurality of one-piece-mountable-hook 110 rainie-clips 170. Each of one-piece-mountable-hook-portion 110 rainie-clips 170, structured and arranged, comprises left-mounting-hook-portion 175 having left-gutter-hook 176 and left-length 177, right-mounting-hook-portion 180 having right-gutter-hook 181 and right-length 182, and light-string-holder-portion 185 having light-string-holder-length 186 and light-string-holder-hook 187. Rainie-clips 170 are for use on buildings having rain-gutters 197, regardless of type of roof, via left-gutter-hook 176 and right-gutter-hook 181.

Left-length 177 of left-mounting-hook-portion 175 and right-length 182 of right-mounting-hook-portion 180 each comprise length-end 190. Length-end 190 of left-mounting-hook-portion 175 and length-end 190 of right-mounting-hook-portion 180 are joined to form Y-intersection 191. Left-mounting-hook-portion 175 and right-mounting-hook-portion 180 are designed to clip onto and be secured to the back edge of rain gutter 197 attached to the roof trim board of building 105.

As a one piece unit, each of one-piece-mountable-hook 110 rainie-clips 170 is manufactured of 18 gauge bendable wire for suitable corrosion resistance against ambient weather, with left-mounting-hook-portion 175 interfused to first-end 178 of left-length 177 and right-mounting-hook-portion 180 interfused to first-end 183 of right-length 182. Second-end 179 of left-length 177 and second-end 184 of right-length 182 are interfused to Y-intersection 191. Y-intersection 191 is interfused to light-string-holder-length 186 and light-string-holder-length 186 is interfused with light-string-holder-hook 187. Light-string-holder-length 186 and light-string-holder-hook 187, together comprising about seven/eights inch, are dipped into rubber composition 188 to provide a cushion for string of decorative lights 195 when in use. Each of light-string-holder-hooks 187 is able to hold a section of string of decorative lights 195. Other non-corrosive materials may also be used for the construction of rainie-clips 170.

Rainie-clip 170 comprises overall rainie-clip-length 171 of approximately two and one/half inches and rainie-clip-width 172 of approximately two inches between left-gutter-hook 176 and right-gutter-hook 181 when mounted on gutter 197. Each of left-gutter-hooks 176 and right-gutter-hooks 181 are able to fit snugly on a back edge of rain gutters 197 of building 105. Other sizes may be available.

Each of rainie-clips 170 is mountable to rain-gutter 197 by placing and clipping left-gutter-hook 176 and right-gutter-hook 181 on the back edge of rain gutter 197 and shaping rainie-clip 170 via first-bend 193 and second-bend 194 to fit on gutter 197. Since string of decorative lights 195 lays on rubber coated light-string-holder-hook 187, the user is further protected from electric shocks and burns during installation. String of decorative lights 195 extends the length of the rain-gutter using an appropriate number of rainie-clips 170.

Easy use hook system for suspending light strands system 100 may be sold as kit comprising the following parts: at least one package of 100 one-piece-mountable-hooks 110; and at least one set of user instructions. The package 100 one-piece-mountable-hooks 110 may comprise 100 birdy-clips 112, 100 nellie-clips 135, 100 rakie-clips 155 or 100 rainie-clips 170. The kit has instructions such that functional relationships are detailed in relation to the structure of the invention (such that the invention can be used, maintained, or the like in a preferred manner). Easy use hook system for suspending light strands 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A combination of a string of decorative lights and an easy use hook system comprising:

a string of decorative lights including:

a plurality of decorative lights; and an electrical wire electrically connecting said plurality of decorative lights in a series circuit; and an easy use hook system comprising:

a plurality of one-piece-mountable-hooks, each of said one-piece-mountable hooks structured and arranged comprising:

a left-mounting-hook-portion;

a right-mounting-hook-portion;

a left-length-portion having a left-length-first-end and a left-length-second-end;

a right-length-portion having a right-length-first-end and a right-length-second-end; and a light-string-holder-portion having a light-string-holder-length and a light-string-holder-curved-hook;

wherein said left-mounting-hook-portion is interfused to said left-length-first-end of said left-length-portion;

wherein said right-mounting-hook-portion is interfused to said right-length-first-end of said right-length-portion;

wherein said left-length-second-end of said left-length-portion is interfused to a first-end of said light-string-holder-length;

wherein said right-length-second-end of said right-length-portion is interfused to said first-end of said light-string-holder-length; and wherein a user is able to use as many of said plurality of one-piece-mountable-hooks as desired in series to suspend said string of decorative lights on an outside wall of a building by attaching each of said one-piece-mountable-hooks on said outside wall of said building via said left-mounting-hook-portion and said right-mounting-hook-portion and then suspend said string of decorative lights using each of said light-string-holder-curved-hooks of said light-string-holder-portion of said one-piece-mountable-hooks along a length of said outside wall of a building;

wherein each of said one-piece-mountable hooks having said left-mounting-hook-portion, said right-mounting-hook-portion, said left-length-portion having said left-length-first-end and said left-length-second-end, said right-length-portion having said right-length-first-end and said right-length-second-end, and said light-string-holder-portion having a light-string-holder-length and a light-string-holder-curved-hook structurally arranged comprises a birdy-clip;

wherein said birdy-clip comprises a tapered V-shape from a top of said birdy-clip to said first-end of said light-string-holder-length; and wherein said birdy-clip is mountable on said metal-bird-stop on a facial-board by placing said left-mounting-hook-portion and said right-mounting-hook-portion through a weep-hole on said metal-bird-stop, said birdy-clip being held in place via pressure.

2. The combination of claim 1 wherein said birdy-clip is for use on said building having raised tiles and a metal-bird-stop designed to repel birds.

3. The combination of claim 1 wherein said birdy-clip comprises heavy duty stainless steel material for suitable corrosion resistance against ambient weather.

4. The combination of claim 1 wherein said birdy-clip comprises a birdy-clip-length of one and one/fourth inch between a top of said birdy-clip to a bottom of said birdy-clip.

5. The combination of claim 1 wherein said birdy-clip comprises a width of three/fourths inch across a top-side of said birdy-clip.

6. The combination of claim 5 wherein said light-string-holder-portion comprises a light-string-holder-portion-length of seven/eights inch.

7. The combination of claim 6 wherein said light-string-holder-portion is dipped in a rubber-composition to provide a cushion for said string of decorative lights when in use.

8. The combination of claim 7 wherein said string of decorative lights comprises holiday lights.

* * * * *